US006032599A

United States Patent [19]

Leboe

[11] Patent Number: 6,032,599

[45] Date of Patent: Mar. 7, 2000

[54] SUSPENSION APPARATUS FOR A SAILBOARD

[75] Inventor: Elliot B. Leboe, Houston, Tex.

[73] Assignee: Chopshok Ltd. Co., Houston, Tex.

[21] Appl. No.: 08/977,999

[22] Filed: Nov. 25, 1997

[51] Int. Cl.[7] ..... B63B 35/79

[52] U.S. Cl. ..... 114/39.12; 114/39.32; 114/91

[58] Field of Search ..... 114/90, 39.1, 39.2, 114/39.32, 39.12, 91, 93

[56] References Cited

U.S. PATENT DOCUMENTS

| | | | |
|---|---|---|---|
| 4,073,254 | 2/1978 | Marker | 114/39.32 |
| 4,166,425 | 9/1979 | Kummetz | 114/357 |
| 4,462,327 | 7/1984 | Pertramer et al. | 114/90 |
| 4,825,792 | 5/1989 | de Vos . | |
| 4,945,846 | 8/1990 | Miley | 114/90 |

FOREIGN PATENT DOCUMENTS

| | | |
|---|---|---|
| 903217A | 3/1986 | Belgium . |
| 0142199 | 5/1985 | European Pat. Off. . |
| 0259929 | 3/1988 | European Pat. Off. . |
| 0351642 | 1/1990 | European Pat. Off. . |
| 3300178 | 7/1984 | Germany . |
| 3629301 | 3/1988 | Germany . |

*Primary Examiner*—Stephen Avila
*Attorney, Agent, or Firm*—Rosenthal & Osha LLP

[57] ABSTRACT

A suspension apparatus is described for use in the sport of windsurfing. The apparatus reduces loads exerted by a mast member on a sailboard, and includes a shock absorbing system having a compressible element, a housing connected to the shock absorbing system, and a base on the sailboard. The shock absorbing system is also connected to the mast member.

18 Claims, 16 Drawing Sheets

SUSPENSION APPARATUS FOR A SAILBOARD

FIELD OF THE INVENTION

The invention relates to a sailboard system. More particularly, this invention relates to a suspension apparatus for reducing the load between a sailboard mast member and a sailboard.

BACKGROUND OF THE INVENTION

In the sport of windsurfing, a rider stands on a sailboard that is floating on a body of water. A mast member is movably mounted on the sailboard and a sail is mounted to the mast member. Typically, the mast member is mounted to the board via a rubber gooseneck fitting. As wind hits the sail, the sailboard is propelled across the water. By altering the position of the mast member and sail with respect to the sailboard, the rider can change speed and direction of the sailboard.

The axial loads exerted onto the sailboard by the mast member can be significant in competitive and/or high-performance windsurfing applications such as racing and/or performing tricks. These loads are further increased by high winds and choppy water. For example, when a sailboard jumps from the crest of a wave into the trough of the wave, significant loads are exerted from the mast member onto the sailboard. It is known that these perpendicular loads between the mast member and the sailboard can permanently damage the sailboard. This problem is exacerbated by the desire to have lighter weight sailboards (which are typically more fragile) for competitive racing and for performing tricks.

Recently, mechanical universal joints have been used instead of gooseneck fittings to improve the transfer of motive force from the sail to the board. However, this direct mechanical link between the mast member and the board also serves to more directly transfer axial loads, and thus further increases the chances of damage to the board.

Conventional methods to prevent the sailboards from becoming damaged by the stress exerted by the mast member include making the surface of the sailboards harder and stronger using material such as fiberglass cloth or cloth impregnated with carbon. However, these materials increase the cost of the sailboards, can increase the weight of the sailboard, and do not decrease the load the mast member exerts on the sailboard.

Use of an oil-filled cylinder or a gas spring, similar to an automotive-type shock absorber, between the mast member and the sailboard is also known. However, these approaches add significant weight to the sailboard system which is a measurable disadvantage in the high-performance sailboard market.

To attach a mast member to a sailboard, a unshaped spring pin made of metal is conventionally used. These pins derive their spring force from the bent u-shape of the pin. However, as the metal fatigues, the spring force of the pin decreases.

SUMMARY OF THE INVENTION

In some aspects, the invention relates to an apparatus and a method to reduce loads between a mast member and a base attached to a sailboard. Specifically, according to one aspect of the invention, a suspension apparatus for a sailboard is designed for placement between a mast member and a base mounted on the sailboard, the apparatus comprising a housing having a first end connected to the base and a second end; and a shock absorbing system secured to the second end of the housing, the system also secured to the mast member for absorbing loads between the mast member and the base, the system comprising a compressible element. In some embodiments, the compressible element is annular. In some embodiments, the compressible element further comprises a spring and two bumpers. In some embodiments, the compressible element is made of elastomeric material to dampen the load exerted by the mast member on the base. In some embodiments, the compressible element is connected to the housing by an axial member having a first end and a second end, the first end being connected to the compressible element, and the second end being connected to the mast member. In some embodiments, the mast member is a mast alone. In some embodiments, the mast member comprises a mast extender and a mast.

In another aspect, the invention relates to a suspension apparatus comprising an anchor to connect the second end of the axial member to the mast member. In some embodiments, the suspension apparatus includes a spring pin. In some embodiments, the spring pin comprises a spring and first and second buttons coaxially disposed within a spring housing. In some embodiments, the suspension apparatus further comprises a spring pin having two ends; the anchor has an axial hole being perpendicular to the axis of the axial member, the anchor being attached to the second end of the axial member; the spring pin passing through the hole in the anchor, the ends of the spring pin attaching to the mast member to connect the suspension apparatus to the mast member.

In some embodiments, the suspension apparatus comprises a first and second set of twin hex nuts, a first and second washer, a cap, and a mast support in which the cap secures the mast support to the axial member and the compressible element is secured to the axial member by the first and second set of twin hex nets and the first and second washers. In some embodiments, the mast support has elongated slots running parallel to the axial direction of the mast support.

In some embodiments, the compressible element further comprises a first bumper, a separator, and a second bumper abutting the housing, the first bumper being spatially separated from the second bumper by the separator. In some embodiments, each bumper is made of elastomeric material. In some embodiments, the hardness reading of the first bumper is less than the hardness reading of the second bumper. In some embodiments, the hardness of the first bumper is approximately 62 durometers and the hardness of the second bumper is approximately 70 durometers.

In some embodiments, the housing member further comprises a collar member having a collar end and a male end, and a supporting member having a secured end and an open end, the secured end movably secured to the base, the male end of the collar being inserted into the open end of the supporting member, the collar member extending outside the supporting member, and attaching thereto. In some embodiments, the collar member is attached to the supporting member by at least one screw. In some embodiments, the supporting member is provided with elongated slots running parallel to the axial direction of the housing member.

In some embodiments, the housing member comprises a universal cup and a connector fixedly attached to the universal cup, the connector connecting the universal cup to the shock absorbing system. In some embodiments, the connector is a spring pin. In some embodiments, the universal cup possesses a side slot movably connected to the axial member for adjusting the suspension system. In some embodiments, the axial member has a tail.

In another aspect, the invention relates to a shock absorbing system for a suspension apparatus for a sailboard, the suspension apparatus being designed for placement between a mast member and a base mounted on the sailboard, the shock absorbing system comprising an axial member having a first end and a second end; a compressible element to absorb loads between the mast member and the base; an anchor with a hole, the anchor attached to the second end of the axial member; a spring pin to connect the second end of the axial member to the mast member by passing through the hole in the anchor; and a fastener to connect the first end of the axial member to the compressible element. In some embodiments, the fastener further comprises a manually adjustable element. In some embodiments, the compressible element is annular and has an axial hole along its length, the axial member passing through the hole.

In another aspect, the invention relates to a method of adding a suspension apparatus to a sailboard including providing a suspension apparatus that is made up of a housing having a first end and a second end, and a shock absorbing system secured to the second end of the housing, the system comprising a compressible element; disengaging a mast member from the sailboard; engaging the first end of the housing to a base; securing the shock absorbing system to the mast member for absorbing loads between the mast member and the base.

In another aspect, the invention relates to a method of absorbing loads between a mast member and a base mounted on the sailboard, comprising the steps of providing a housing having a first end connected to the base and a second end; providing a shock absorbing system secured to the second end of the housing, the system also secured to the mast member for absorbing loads between the mast member and the base, the system comprising a compressible element.

In another aspect, the invention relates to a suspension apparatus for a sailboard, the apparatus being designed for placement between a mast member and a base mounted on the sailboard, the apparatus comprising a housing having a first end connected to the base and a second end; means for absorbing loads between the mast member and the base, the second end of the housing being connected to the means for absorbing loads.

In some aspects, the invention relates to a suspension apparatus for a sailboard, the apparatus being designed for placement between a mast member and a base mounted on the sailboard, the apparatus being made up of a housing having a first end connectable to the base and a second end; means for absorbing loads between the mast member and the base, said means being mounted to the second end of the housing.

DESCRIPTION OF THE PREFERRED EMBODIMENTS

Preferred embodiments of the invention will now be described with reference to the accompanying figures.

The invention relates to an apparatus and a method to reduce the axial loads exerted by a mast member on a sailboard. The invention reduces these loads without adding significant weight to the sailboard system. Reduction of this load also leads to improved control when performing tricks, and to increased speed for high performance windsurfing. Further, in some embodiments the invention is configurable to adjust the amount of load the rider wants the apparatus to absorb. Further aspects and advantages of the invention will become apparent from consideration of the following description and drawings.

Figure 1:
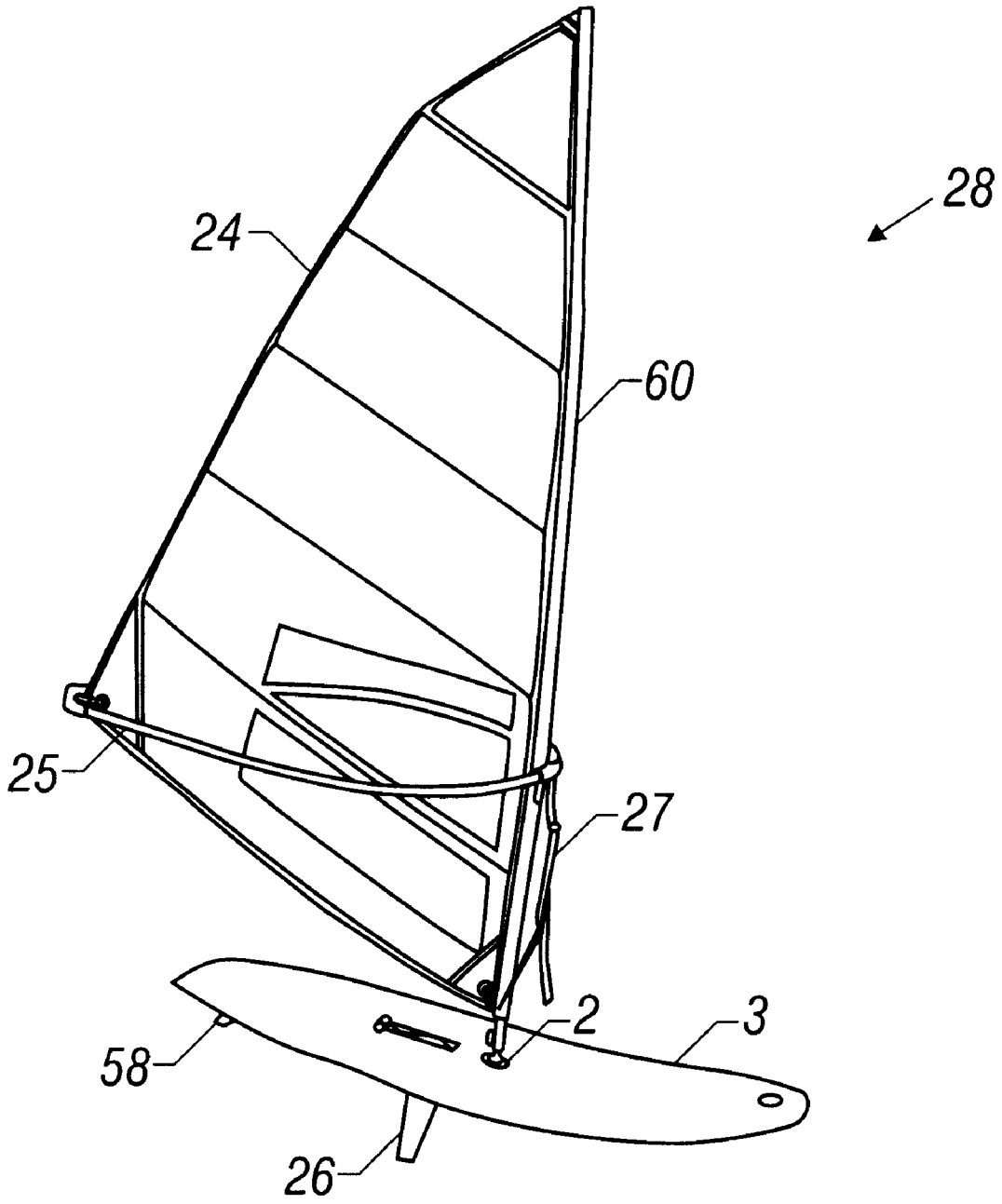
Figure 1 (Prior Art)
FIG. 1 shows a prior art sailboard system.

Referring to FIG. 1, a prior art sailboard system 28 is made up of mast member 60, sailboard 3, and base 2 to connect mast member 60 to sailboard 3. In operation, a rider (not pictured) stands on sailboard 3 that is on the water's surface. Initially, mast member 60 and sail 24 also rest on the water. To begin to windsurf, the rider pulls uphaul cord 27 to raise mast member 60 and sail 24 out of the water until mast member 60 is approximately perpendicular to sailboard 3. At this point, the rider holds on to mast member 60 and handle 25 and releases uphaul cord 27.

In operation, wind hits sail 24 to propel sailboard system 28 across the water. The rider (not pictured) can steer sailboard system 28 by changing the position of sail 24 with either handle 25 or mast member 60. Further, backfin 58 and centerboard 26 stabilize sailboard 3 and provide direction. By using handle 25, the rider can rotate sail 24 about mast member 60 to change the direction of sailboard system 28.

Figures 2A, 2B, 2C:
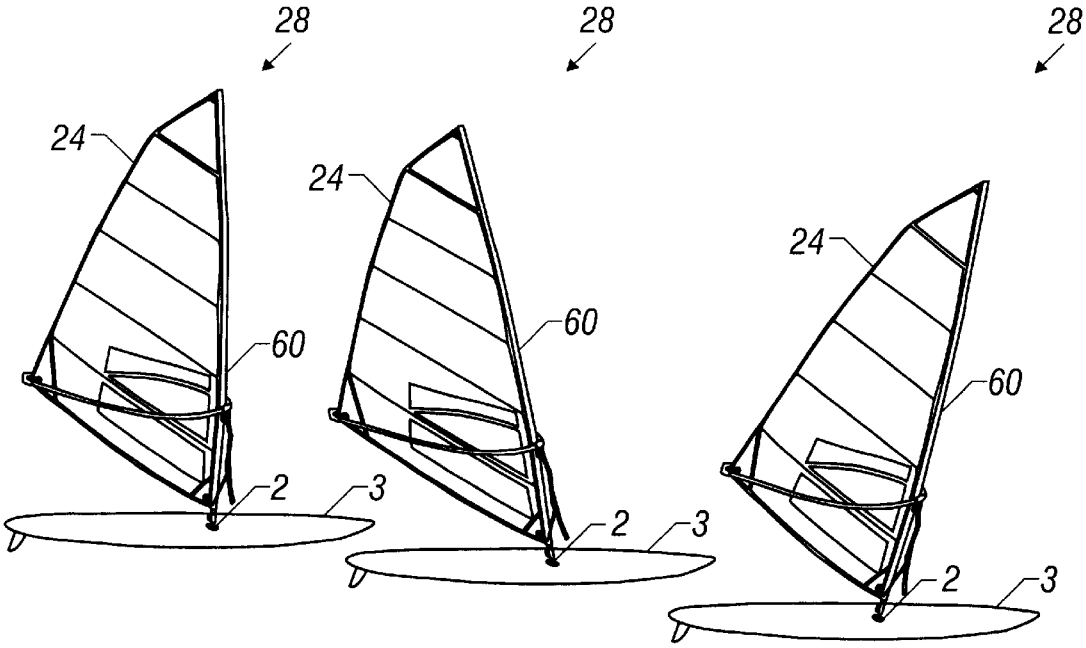
Figure 2A (Prior Art)
Figure 2B (Prior Art)
Figure 2C (Prior Art)
FIGS. 2A–C show mast member and sail movement relative to the sailboard.

Referring to FIGS. 2A–2C, in operation the mast member 60 moves relative to sailboard 3. Referring to FIG. 2A, mast member 60 is approximately perpendicular to sailboard 3. However, when steering sailboard system 28, the rider may change the position of mast member 60 as shown in FIGS. 2B and 2C because of the flexible nature of base 2. Further, the rider may rotate sail 24 about mast member 60.

Figure 3A:
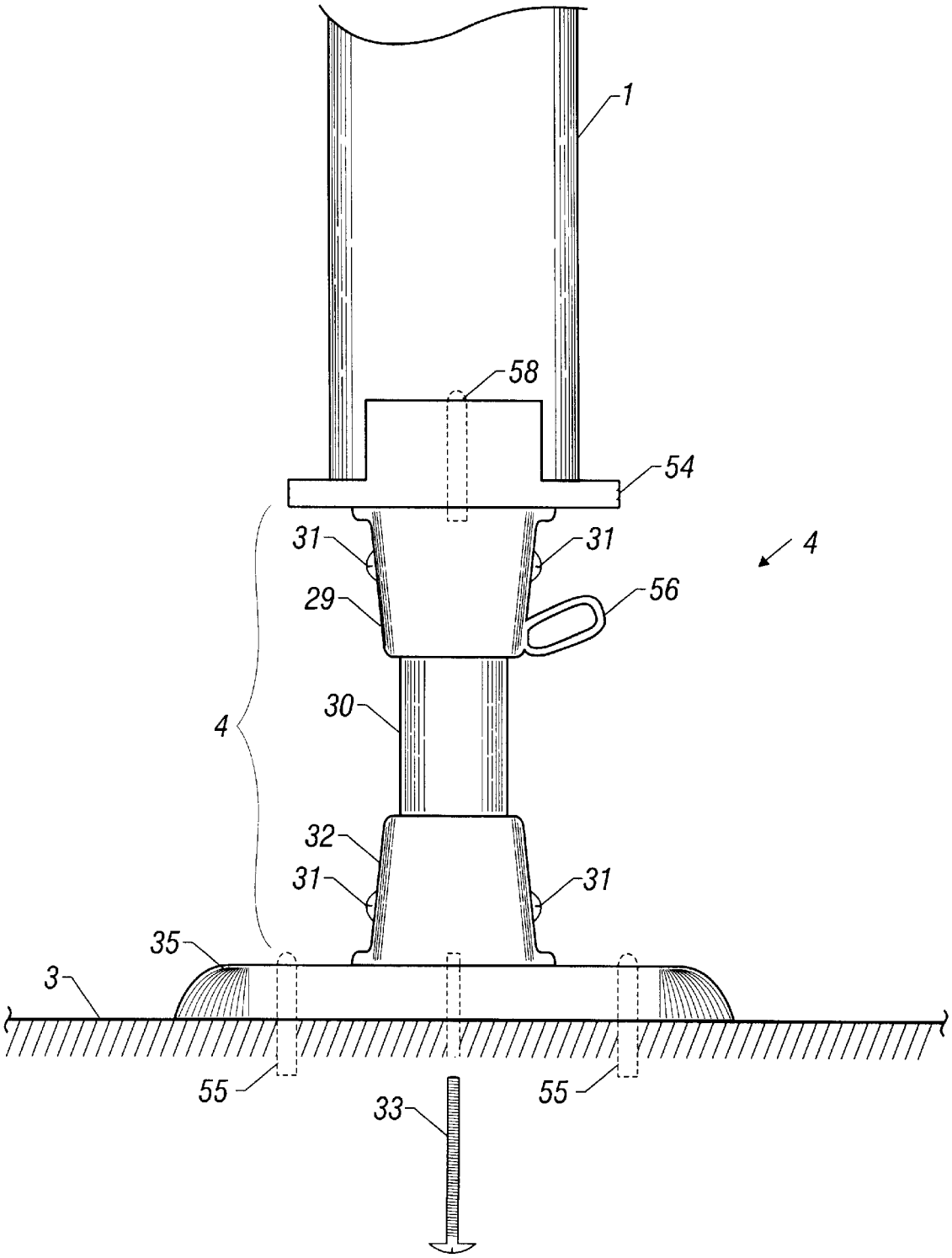
Figure 3A (Prior Art)
FIG. 3A shows a prior art gooseneck fitting connecting a sailboard and a mast member that is made up of a mast alone.
Figure 3B:
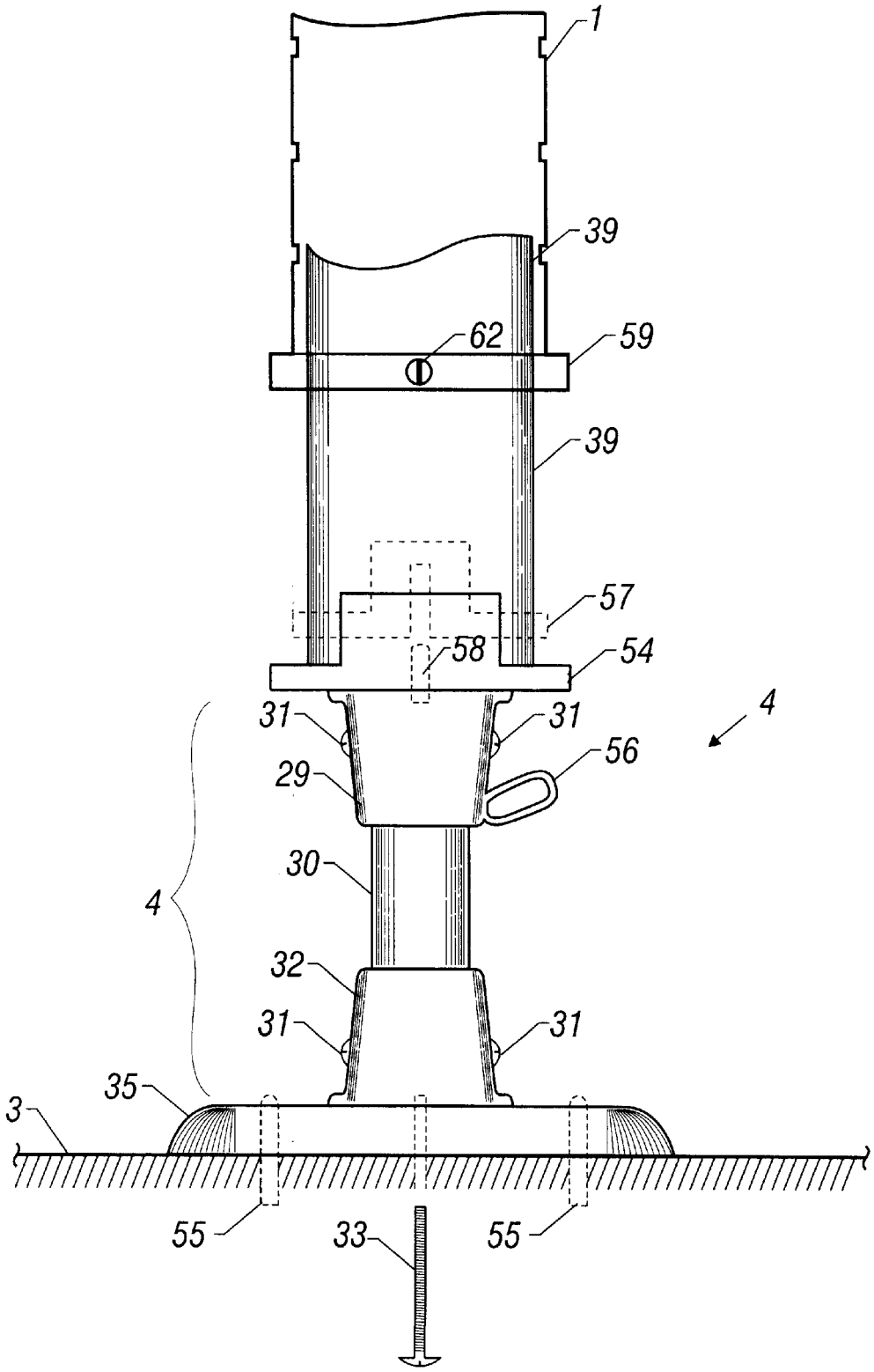
Figure 3B (Prior Art)
FIG. 3B shows a prior art gooseneck fitting connecting a sailboard to a mast member that includes a mast extender.
Figure 4A:
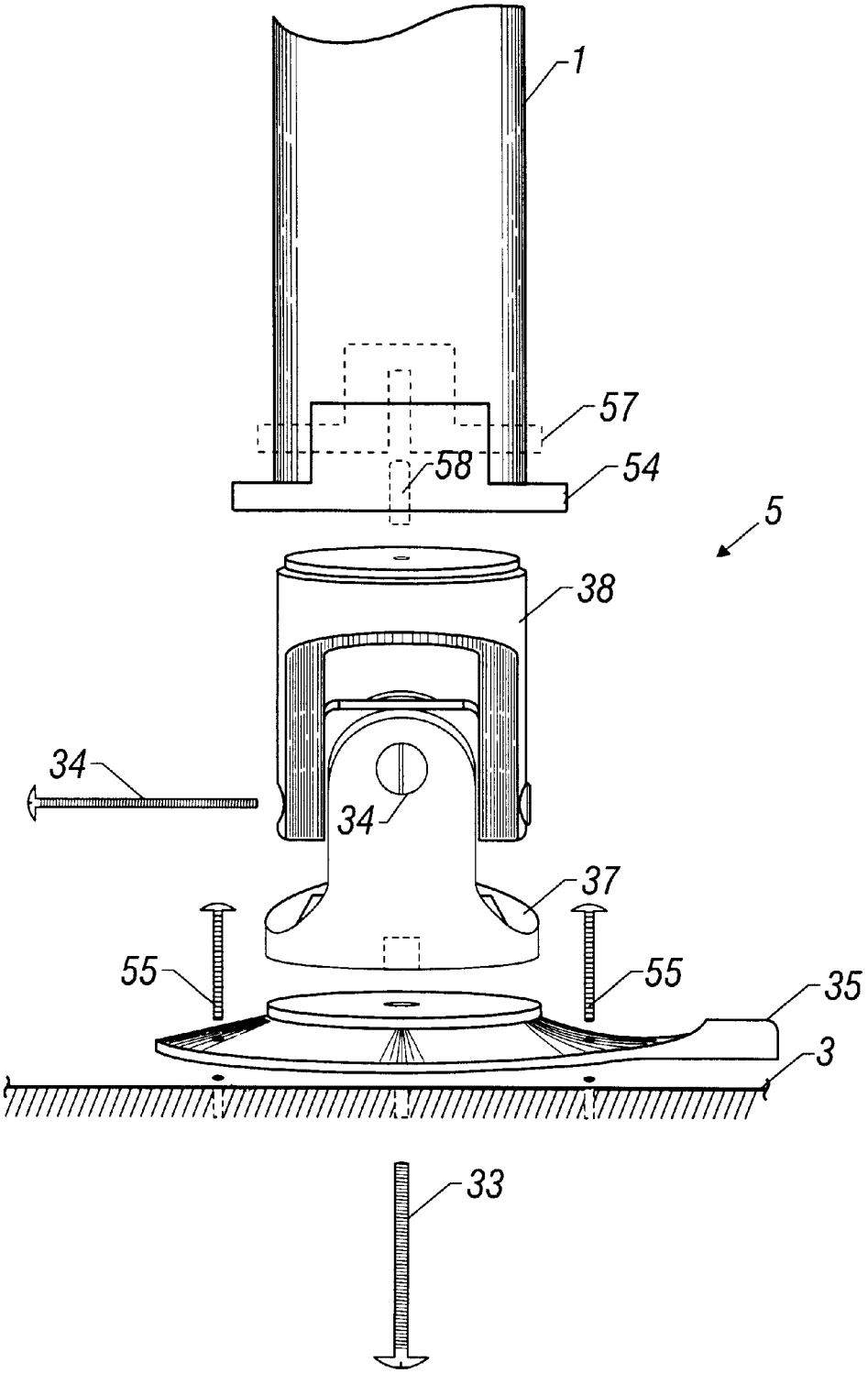
Figure 4A (Prior Art)
FIG. 4A shows a prior art mechanical universal joint connecting a sailboard and a mast member made up of a mast alone.
Figure 4B:
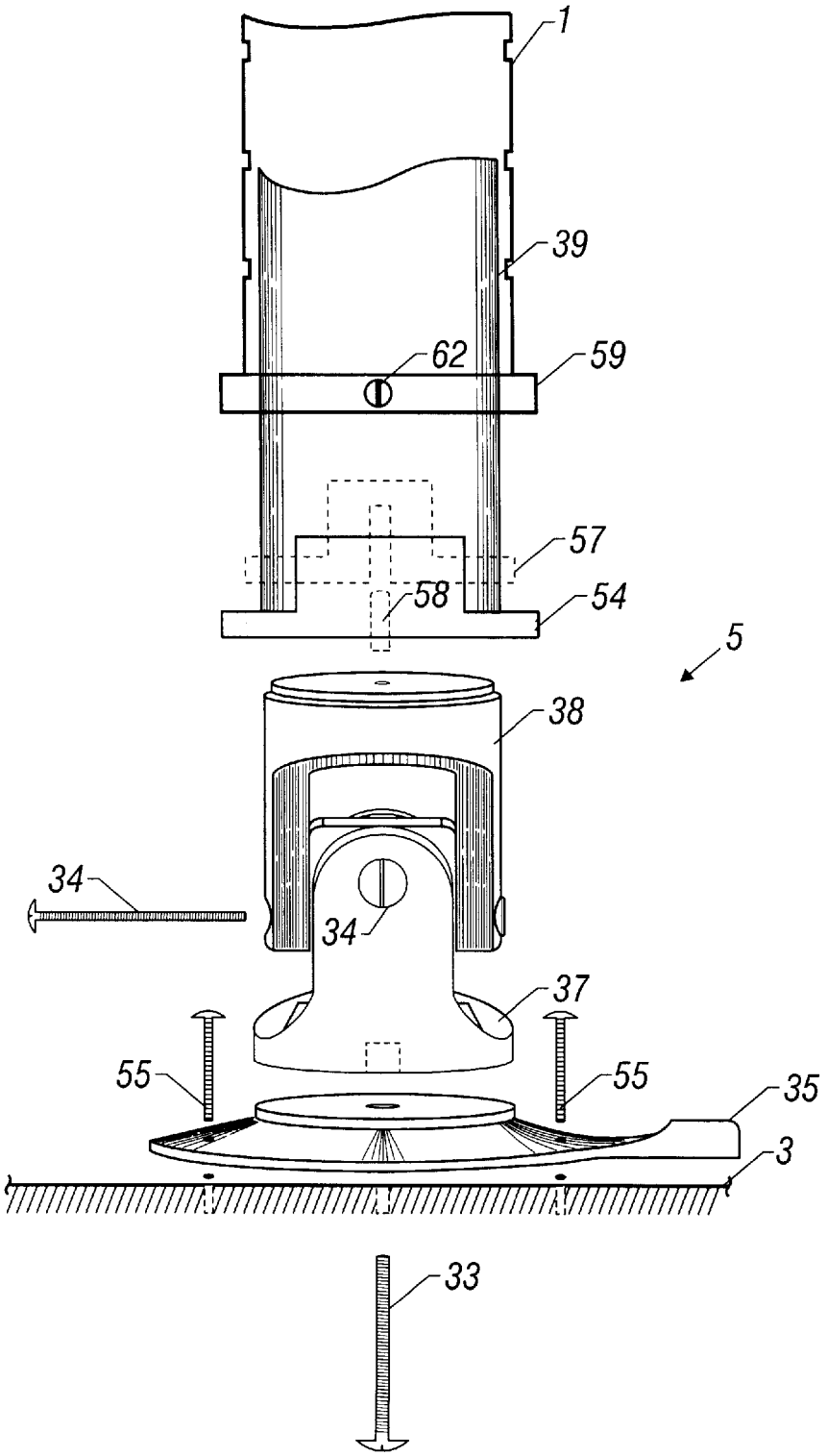
Figure 4B (Prior Art)
FIG. 4B shows a prior art mechanical universal joint connecting a sailboard to a mast member that includes a mast extender.

Base 2 shown in FIG. 2 must perform two functions simultaneously. First, it must provide a link between the mast member 60 and the sailboard 3 such that the motive force caused by the wind hitting the sail is transferred to the sailboard. Second, the base 2 must allow for flexibility between mast member 60 and the sailboard 3 in all directions. Base 2 is commercially available in various forms. For example, base 2 can be a gooseneck fitting 4 as shown in FIGS. 3A and 3B or a mechanical universal joint 5 as shown in FIGS. 4A and 4B. Further, the mast member can be made up of various components. For example, the mast member can be made up of mast 1 alone (as shown in FIG. 3A) or the mast member can be made up of mast 1, resting on collar 59, which is attached to mast extender 39 by collar pin 62 (as shown in FIG. 3B). The mast extender is used to adapt the overall length of the mast member to accommodate sails of different sizes.

Referring to FIG. 3A, gooseneck fitting 4 is made up of upper collar 29, flexible tendon 30, and bottom collar 32. In this figure, the mast member is made up of mast 1 alone. Mast 1 rests on cup 54. Cup 54 is attached to upper collar 29 by bolt 58. Screws 31 attach upper collar 29 to flexible tendon 30. Flexible tendon 30 is made from flexible material such as rubber to allow the position of mast 1 to change relative to sailboard 3. Flexible tendon 30 is attached to bottom collar 32 by screws 31. Base bolt 33 attaches bottom collar 32 to foundation 35, and bolts 55 attach the foundation to sailboard 3.

Upper collar 29 has a loop 56. A downhaul rope (not shown) is strung through loop 56 to secure mast 1 in position by firmly attaching to sail 24 (shown in FIG. 1) which is firmly attached to mast 1.

Referring to FIG. 3B in which the same gooseneck fitting as shown in FIG. 3A is used, gooseneck fitting 4 is shown attached to a cup 54 by pin 58. In this embodiment, the mast member is comprised of mast 1, mast extender 39, collar 59 and collar pin 62. Collar 59 attaches to mast extender 39 by collar pin 62. Mast 1 surrounds mast extender 39 and rests on collar 59. Cup 54 is attached to mast extender 39 by prior art pin 57. Thus, gooseneck fitting 4 can be utilized with any mast member: the mast alone or the mast connected to the mast extender by a collar and collar pin, for example. Prior art pin 57 is a cylindrical piece of metal that is bent in a U-shaped configuration.

Referring to FIG. 4A, mechanical universal joint 5 is made by connecting a top u-joint member 38 to a bottom u-joint member 37 with pins 34 in a conventional fashion. Bottom u-joint member 37 is attached to foundation 35 and sailboard 3 by base bolt 33, and foundation 35 is also connected to sailboard 3 by bolts 55. Cup 54 is attached to upper u-joint member 38 by bolt 58. In this figure, the mast member is made up of mast 1 alone. Mast 1 is attached to cup 54 by prior art pin 57.

Referring to FIG. 4B in which the same mechanical u-joint as shown in FIG. 4A is used, mechanical u-joint 5 is shown attached to cup 54 by bolt 58. In this figure, the mast member is comprised of mast 1 surrounding mast extender 39 and resting on collar 59. Collar 59 is attached to mast extender 39 by collar pin 62. Mast extender 39 is attached to cup 54 by prior art pin 57. Thus, mechanical u-joint 5 can be utilized with any variety of mast members.

Referring to FIGS. 5A–5E, these embodiments of the invention show a suspension apparatus made up of a shock absorbing system and a housing member. The shock absorbing system is further made up of a compressible element, an axial member 11, a fastener, an anchor 12, and a spring pin 13. In this embodiment, the compressible element is shown to be comprised of a first bumper 14, a separator 15, and a second bumper 16. Preferably, first bumper 14 and second bumper 16 are composed of elastomeric material and separator 15 is composed of plastic. Preferably, second bumper 16 is made of an elastomeric material with a higher hardness value than that of first bumper 14. First bumper 14 may be composed of pre-dampened elastomeric material with a hardness value of, for example, 62 durometers while second bumper 16 may be composed of elastomeric material with a hardness value of, for example, 70 durometers.

Referring again to the embodiments in FIGS. 5A–D, a housing member is comprised of a collar member 9 nested within supporting member 10. To secure the compressible element (which is made up of first bumper 14, separator 15, and second bumper 16 in this embodiment) to the housing member (made up in this embodiment by collar member 9 nested within supporting member 10), axial member 11 passes through holes in first bumper 14, separator 15, and second bumper 16. Preferably, the first bumper 14, separator 15, and second bumper 16 are annular, each with a hole in its axial center through which axial member 11 passes. First bumper 14, separator 15, and second bumper 16 are secured to collar member 9 by a fastener. In this embodiment, the fastener is made up of second washer 20, first washer 19, and wing nut 18 on the end of axial member 11. Preferably, first washer 19 has a larger diameter than second washer 20.

In these embodiments, a housing member is comprised of a collar member 9 nested within supporting member 10. The collar member 9 is attached to the supporting member 10 by two screws 23. The supporting member 10 has two elongated, diametrically opposed slots 44 in its walls. In operation, each end of a spring pin 13 (shown in detail in FIG. 5C) extends through the elongated holes in the supporting member 10, thereby connecting mast member 60 to axial member 11 by using anchor 12 (shown in detail in FIG. 5D). Anchor 12 is attached to axial member 11. Preferably, axial member 11 is threaded, and anchor 12 has a threaded hole into which axial member 11 may be inserted.

In operation, sailboard 3 moves relative to mast member 60. The force exerted by mast member 60 in a direction toward sailboard 3 is absorbed in these embodiments of the suspension apparatus as follows: mast member 60 exerts a force spring pin 13; spring pin 13 is attached to anchor 12 and therefore exerts the force onto anchor 12 which is connected to axial member 11. Wing nut 18, first washer 19 and second washer 20 therefore transfer the force from the axial member 11 to the compressible element (comprised of first bumper 14, separator 15, and second bumper 16). The compressible element (comprised of first bumper 14, separator 15, and second bumper 16 in this embodiment) connects to the collar member 9 by abutting collar member 9. Collar member 9 is fixed against supporting member 10 which is fixed against base 2 by bolt 58. Base 2 is connected to foundation 35 and sailboard 3 by base bolt 33. Foundation 35 is also secured to sailboard 3 by bolts 55. Therefore the compressible element either expands or contracts depending on the direction of the force. In this embodiment, first bumper 14 and second bumper 16 expand or contract to absorb the axial load. Excess axial load that the compressible element cannot absorb is transferred from the compressible element via the axial member to the housing member (made up here by collar member 9 and supporting member 10), base 2, foundation 35, and finally sailboard 3. In this manner, the relative movement of mast member 60 and the sailboard 3 is controlled by the suspension apparatus.

The performance of the suspension apparatus can be changed in different ways. For example, changing hardness values of the bumpers affects the performance of the suspension apparatus. Use of harder values makes the suspension apparatus more rigid, thereby allowing forces from the mast member to be more directly transferred to the sailboard than if softer values were used; using harder values also increases the speed of the sailboard. For lower hardness values, the inverse is true. These values can be adjusted depending on the user's desired attributes of the suspension apparatus.

Further, fine-tuning of the suspension apparatus for the desired performance may be accomplished by adjusting the fastener. The location of the fastener on axial member 11 affects the performance of the suspension apparatus. Securing the fastener on axial member 11 in a direction closer to the housing compresses the compressible element such that the compressible element is more rigid. Thus, less axial load is absorbed by the suspension apparatus than if the fastener were secured in a direction farther away from the housing. In these embodiments, tightening wing nut 18 (and thus moving its position on axial member 11 closer to collar member 9) initially compresses the first bumper 14 and second bumper 16 making them less capable of absorbing axial loads.

The length of the elongated slots 44 determines the amount of relative vertical movement allowed between sailboard 3 and the mast member 60: the longer the elongated slots, the more travel allowed.

Figure 5A:
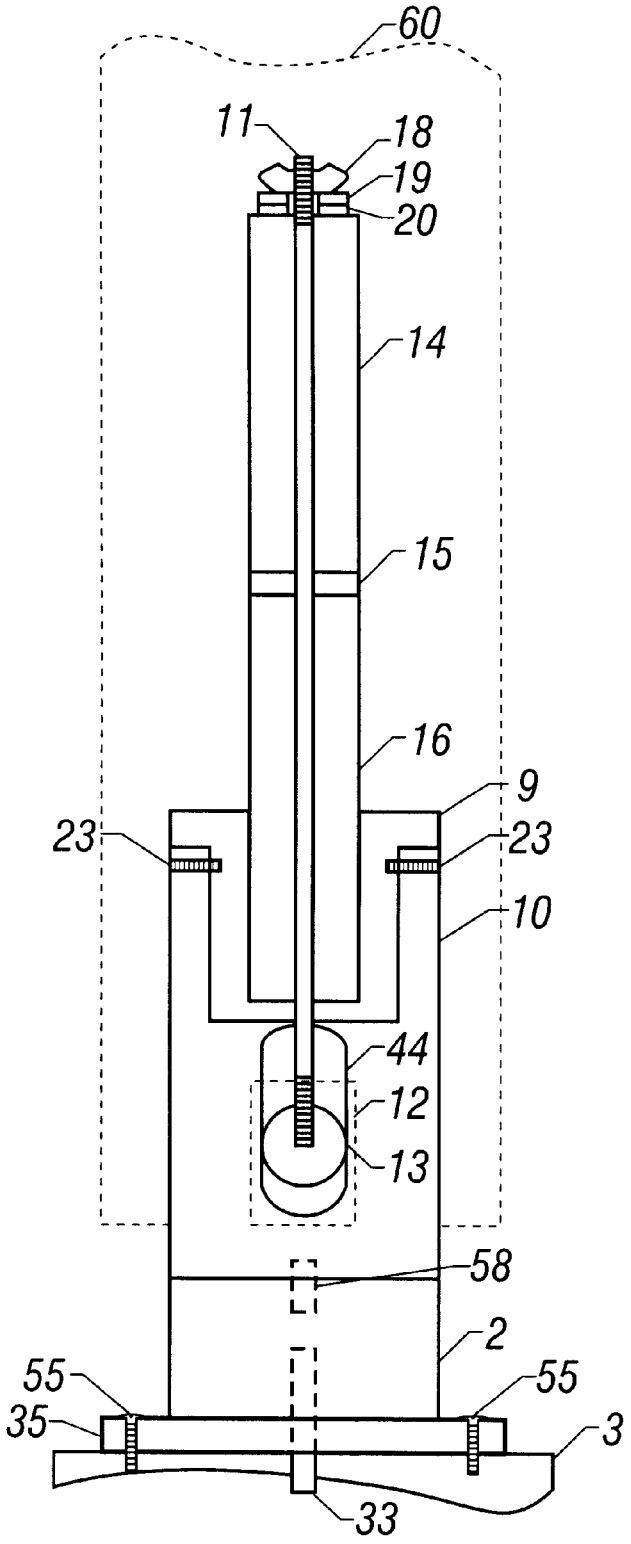
FIG. 5A is a detailed cross-sectional view of an embodiment of the invention.
Figure 5B:
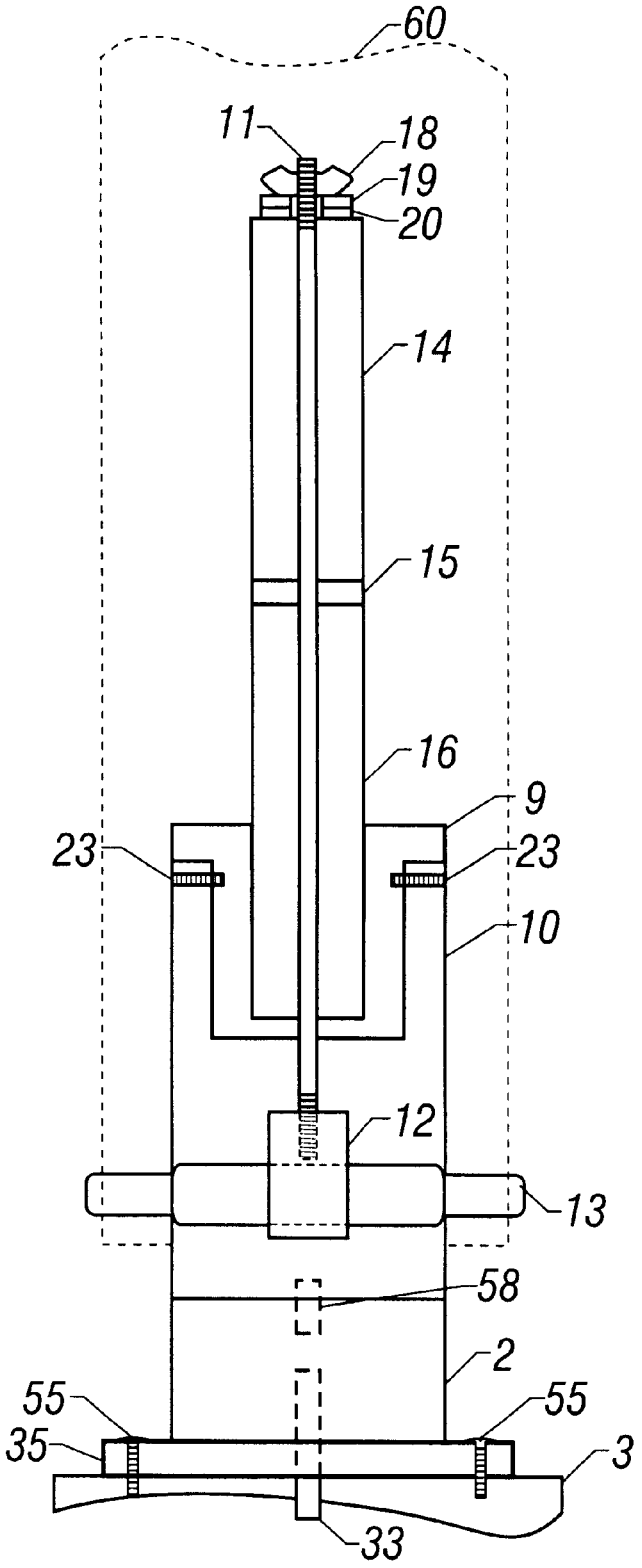
FIG. 5B is a side view of the embodiment of FIG. 5A.
Figure 5C:
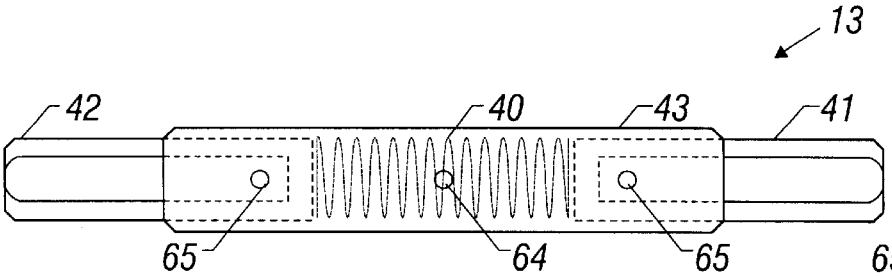
FIG. 5C shows a spring pin.
Figure 5D:
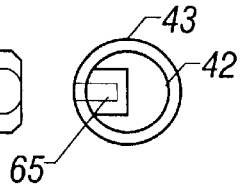
FIG. 5D shows the side view of a spring pin.
Figure 5E:
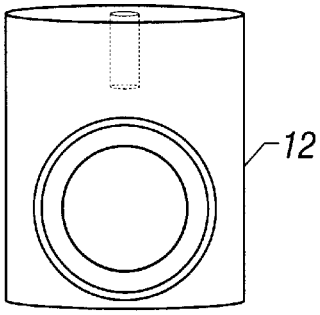
FIG. 5E shows an anchor.
Figure 7A:
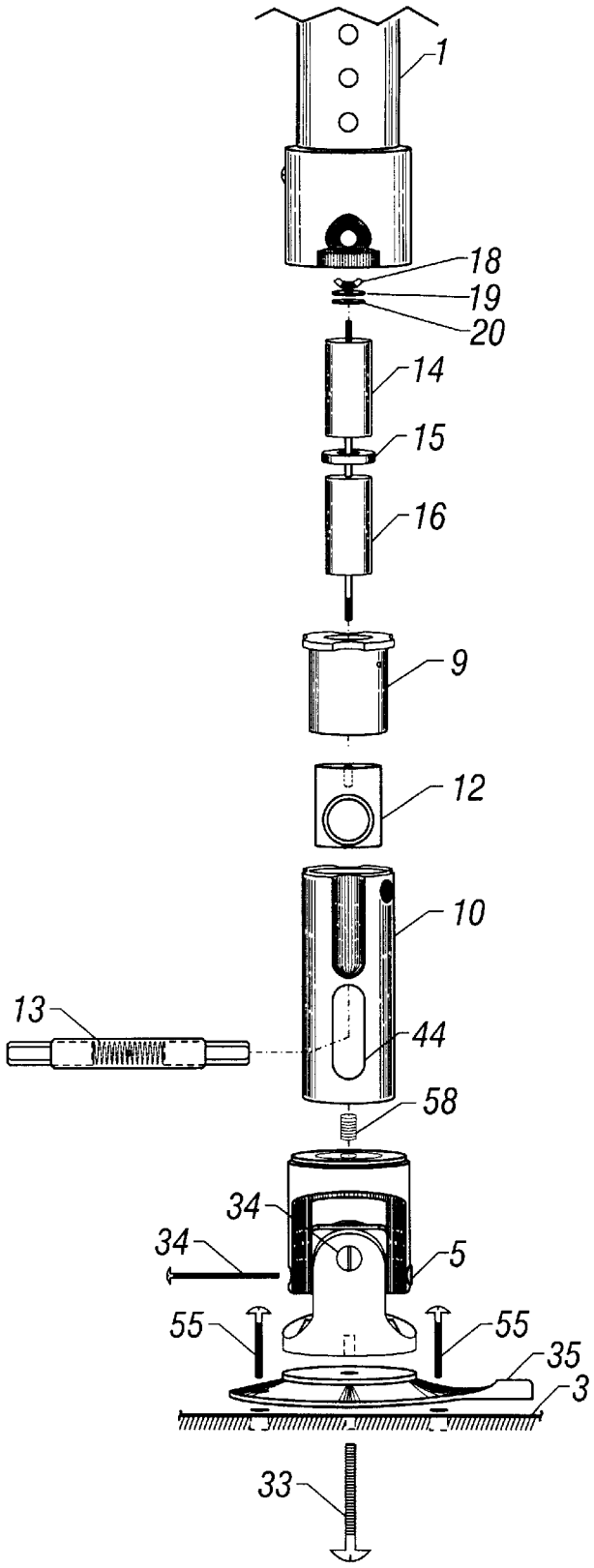
FIG. 7A shows an exploded view of the embodiment of FIG. 5A.
Figure 7B:
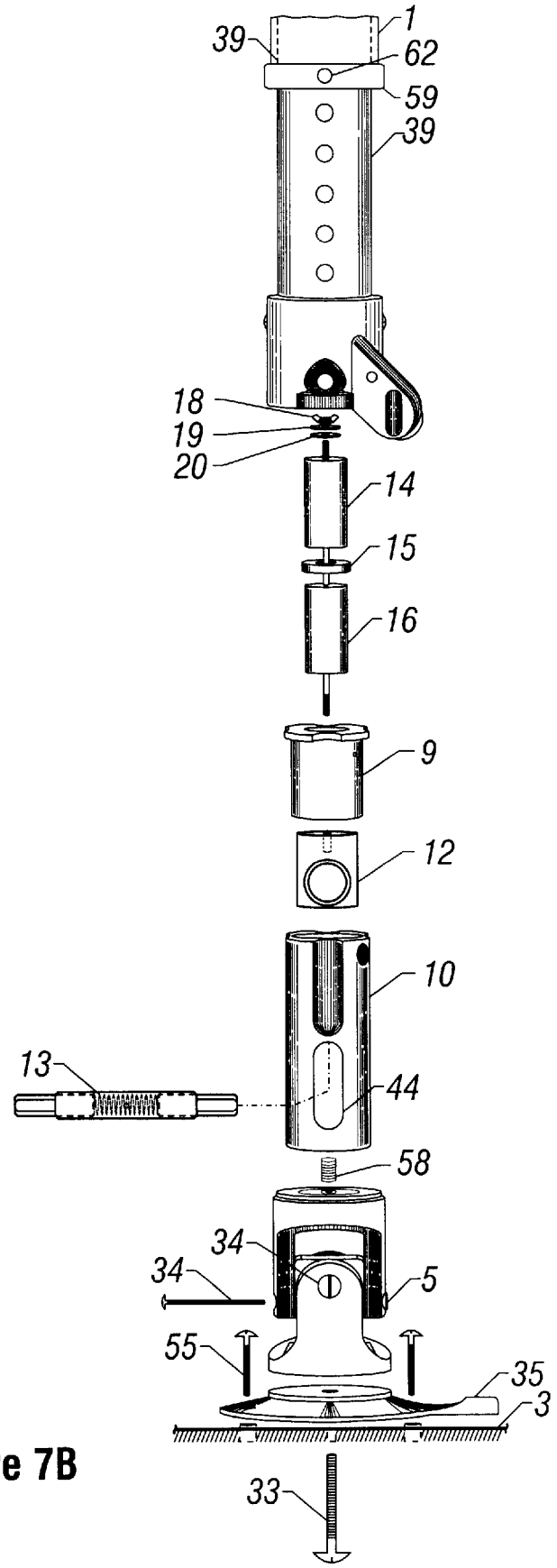
FIG. 7B shows an exploded view of an embodiment with the mast member including a mast and a mast extender.

Referring to FIGS. 5C and 5D, spring pin 13 is comprised of mini-spring 40, right button 41, left button 42, push pins 65, and pin housing 43. Right button 41 and left button 42 are coaxially located within either end of spring housing 43. Mini-spring 40 exerts an outward force on right button 41 and left button 42. Right button 41 and left button 42 are retained in pin housing 43 by push pins 65. Pin housing 43 also contains air hole 64. In operation, an inward force on the outside edges of right button 41 and left button 42 places mini-spring 40 in compression. As right button 41 and left button 42 are depressed, mast 1 (as shown in FIG. 7A) or mast extender 39 (as shown in FIG. 7B) can be slipped over supporting member 10. Once in place, the mini-spring 40 forces right button 41 and left button 42 into their original position. The mast member (either mast 1 or mast extender 39, for example) therefore rests on the portion of spring pin 13 which protrudes through supporting member 10. This pin can be contrasted to prior art pin 57 as shown in FIG. 4B, for example. Advantages to spring pin 13 include that mini-spring 40 retains its resilience for long periods of time. Also, right button 41 and left button 42 can withstand higher shear loads due to their housing in spring housing 43. Thus, spring pin 13 is useable for long periods of time and is relatively strong. Although use of spring pin 13 is preferable in the embodiments of the invention, the invention is operable even with prior art pin 57 (as shown in FIG. 3B) or with a standard bolt.

Figure 6:
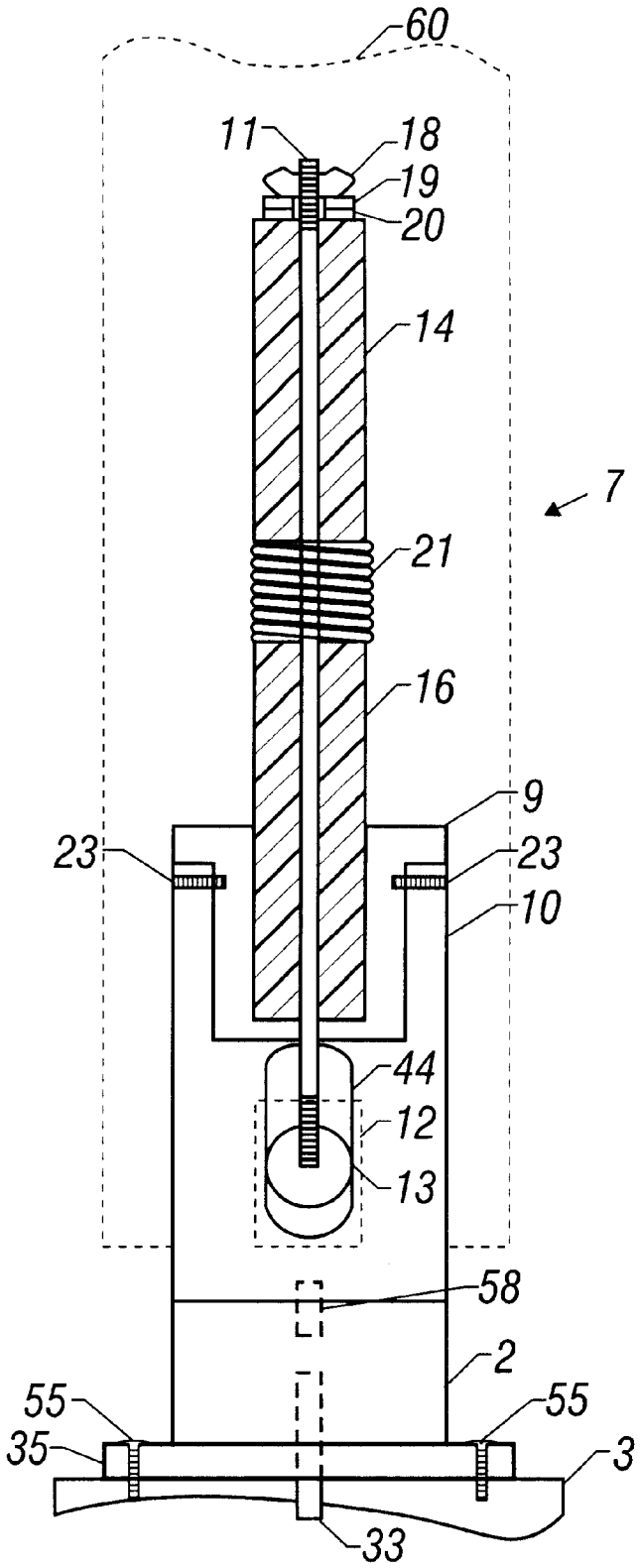
FIG. 6 is a detailed cross-sectional view of another embodiment of the invention.

Referring to FIG. 6, this embodiment shows the compressible element made up of a first bumper 14, a spring 21, and a second bumper 16. This embodiment operates identically to the embodiments shown in FIGS. 5A–5D except that spring 21 also absorbs axial loads. Thus, first bumper 14, spring 21, and second bumper 16 each compress or expand to absorb axial load between mast member 60 and sailboard 3. Mast member 60 could be made up of, for example, a mast alone, or a mast extender resting on a collar attached to the mast extender by a pin.

Referring to FIG. 7A, an embodiment similar to that shown in FIGS. 5A–E is shown in exploded view. In this embodiment, the base is made up of universal joint 5, although any type of base would suffice to attach the embodiment to sailboard 3. Also in this figure, the mast member is shown as made up of mast 1.

Referring to FIG. 7B, an embodiment is shown in which the mast member is made up of a mast 1 surrounding mast extender 39 and resting on collar 59. Collar 59 is connected to mast extender 39 by collar pin 62. Mast extender 39 allows a rider to increase the overall length of mast member 60 which is desired for using different sized sails. One end of mast extender 39 connects to mast 1 while the other end connects to sailboard 3 as follows. Mast extender 39 surrounds supporting member 10 and connects to the shock absorbing system by spring pin 13. In operation, when an axial load is exerted from the mast 1 onto mast extender 39 via collar 59 and collar pin 62, the load is transferred onto first bumper 14, second bumper 16, and separator 15 by spring pin 13, anchor 12, and axial member 11. In these embodiments, first bumper 14 and second bumper 16 compress or expand to absorb portions of the axial load. Comparing FIG. 7A and FIG. 7B, it can be seen that the suspension apparatus is capable of operating with various mast member configurations such as (a) a mast or (b) a mast extender attached to a mast by a collar and a collar pin, for example.

Figure 8A:
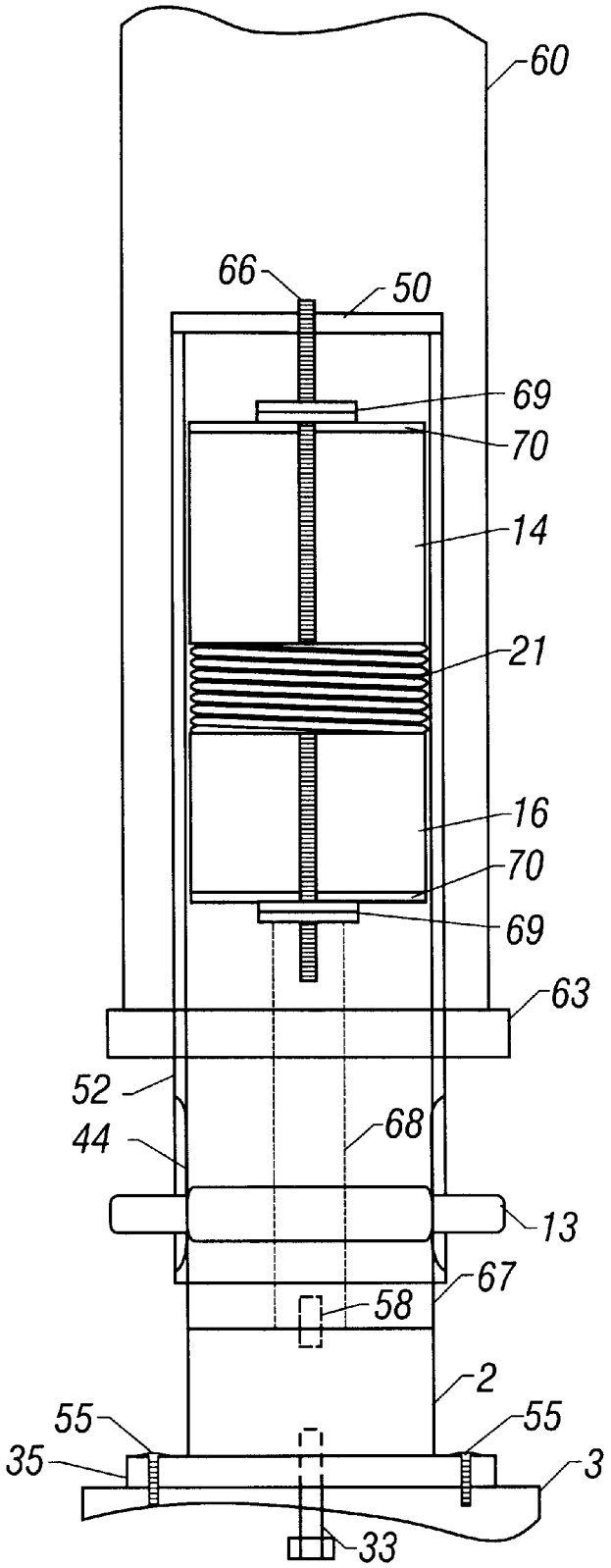
FIG. 8A shows another embodiment of the invention.
Figure 8B:
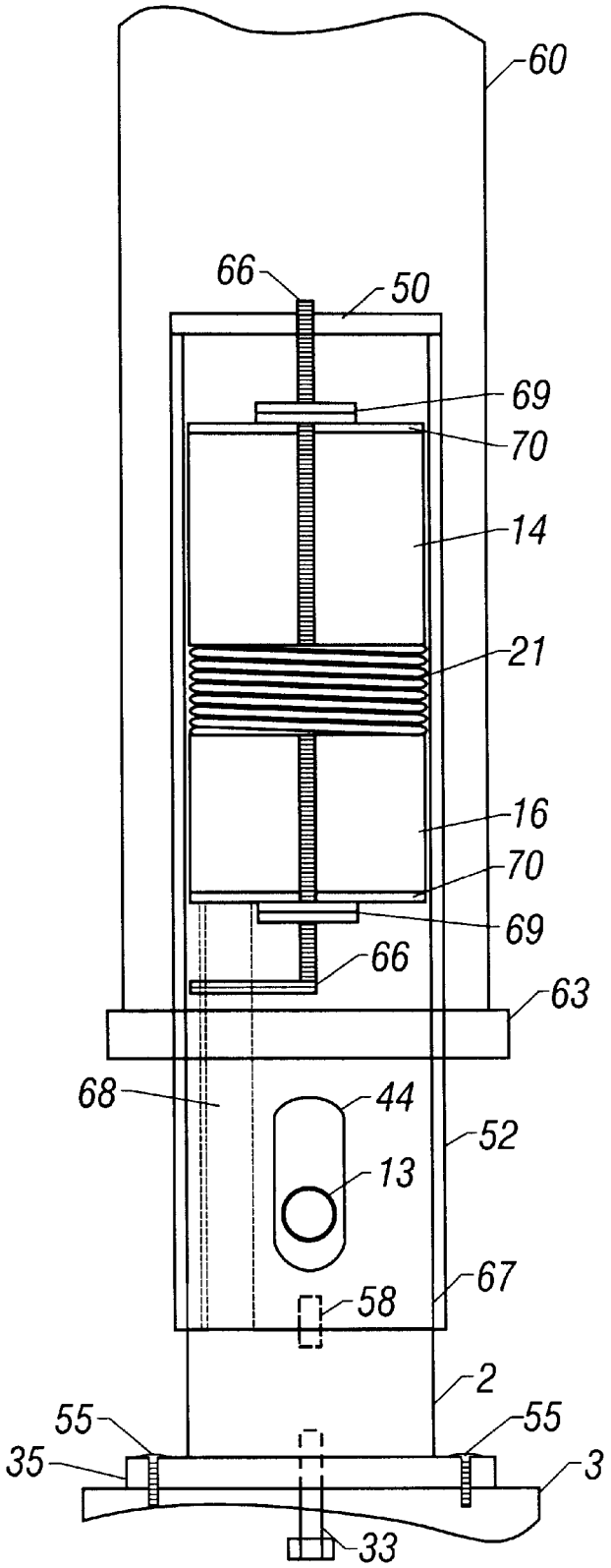
FIG. 8B shows a side view of FIG. 8A.

Referring to FIGS. 8A and 8B, another embodiment of the suspension apparatus is shown. In this embodiment, the suspension apparatus is made up of a shock absorbing system and a housing member. The shock absorbing system includes a compressible element, a tailed axial member 66, twin hex nuts 69, washers 70, cap 50, and mast support 52. Mast support 52 is hollow and contains elongated slots 44. The compressible element is made up of first bumper 14, spring 21, and second bumper 16. Twin hex nuts 69 and washers 70 secure the compressible element along tailed axial member 66. The compressible element also rests on washer 70 which rests on the housing member. The compressible element is movably attached to the housing member by twin nuts 69 and washer 70 via tailed axial member 66.

Cap 50 is preferably made of aluminum and contains a threaded hole into which tailed axial member 66 is inserted. Since cap 50 is attached to mast support 52, cap 50 connects tailed axial member 66 to mast support 52.

In this embodiment, spring pin 13 connects mast support 52 to universal cup 67. Mast support 52 also connects to mast member 60 as follows. Mast member 60 surrounds the circumference of mast support 52. Mast member 60 rests on collar with o-ring 63. Collar with o-ring 63 clamps onto mast support 52.

The housing member is made up of universal cup 67 and a connector. The connector is fixedly attached to the universal cup 67. Universal cup 67 possesses a side slot 68 which runs along the circumference of universal cup 67 for the entire length of universal cup 67. The tail of tailed axial member 66 protrudes through side slot 68 in universal cup 67.

In this embodiment, the connector is shown as spring pin 13. However, prior art pin 57 (shown in FIG. 3B) or even a simple bolt could be used. The connector is attached to universal cup 67 and fits into the elongated slots 44 in mast support 52. Universal cup 67 is rotatably fixed to base 2 by bolt 58; base 2 is attached to foundation 35 and sailboard 3 by base bolt 33. Foundation 35 is also secured to sailboard 3 by bolts 55. Spring pin 13 is attached to universal cup 67, and the ends of spring pin 13 extend into the elongated slots 44 of mast support 52. Thus, relative movement between mast support 52 and universal cup 67 is allowed.

In operation, sailboard 3 moves relative to mast member 60. The axial load exerted by mast member 60 in a direction toward sailboard 3 (i.e. placing the apparatus in compression) is absorbed as follows: mast member 60 exerts a load on mast support 52 via collar with o-ring 63. The axial load is transferred to tailed axial member 66 since mast support 52 is attached to cap 50 which is threaded for tailed axial member 66 to attach. The load is then transferred to the compressible element (shown here as first bumper 14, spring 21, and second bumper 16) via twin hex nuts 69 and washer 70. The compressible element (shown here as first bumper 14, spring 21, and second bumper 16) contracts to absorb part of the axial load. The load which the compressible element cannot absorb is then transferred to mast support 52 since the compressible element rests on washer 70 which rests on mast support 52. The load is therefore transferred from universal cup 67 to base 2, foundation 35, and sailboard 3.

If a load is exerted by mast member 60 in a direction away from sailboard 3 (i.e. the system is in tension), the suspension apparatus reacts as described above, except that the compressible element expands to absorb some of this tensile load. Any load not absorbed by the compressible element places the a tensile axial force on tailed axial member 66. Tailed axial member 66 transfers the load exerted by mast support 52 via cap 50 to universal cup 67 via twin hex nuts 69. This load is therefore transferred to sailboard 3 via foundation 35 and base 2.

The amount of relative movement allowed between mast support 52 and universal cup 67 is limited by the overall length of elongated slots 44 in mast support 52. This is because spring pin 13 is permanently connected to universal cup 67 and protrudes through slots 44 in mast support 52. The length of elongated slots 44 depends on the desires of the user. However, slots approximately 3 inches in length are preferred.

In this manner, the relative movement between mast member 60 and sailboard 3 is reduced by the suspension apparatus.

The performance of the suspension apparatus can be changed in different ways. For example, changing hardness values of the bumpers affects the performance of the suspension apparatus. Use of harder values makes the suspension apparatus more rigid, thereby allowing forces from the mast member to be more directly transferred to the sailboard than if softer values were used. Using harder values also increases the speed of the sailboard. For lower hardness values, the inverse is true. These values can be adjusted depending on the user's desired attributes of the suspension apparatus.

Further, fine-tuning of the suspension apparatus for the desired performance may be accomplished by rotating universal cup 67. The tail of tailed axial member 66 protrudes through slot 68 in universal cup 67. Thus, by rotating universal cup 67, tailed axial member 66 also rotates. Tailed axial member 66 is threaded into cap 50. Thus, by rotating tailed axial member 66, then the relative distance between cap 50 and the tail of tailed axial member 66 changes. Since the compressible element is also attached to slotted mast support 52 by twin hex nuts 69 and washer 70, then by rotating tailed axial member, the compressible element is either compressed or expanded.

Rotating universal cup 67 such that the tail of tailed axial member 66 is closer to cap 50 compresses the compressible element so that the compressible element is more rigid. Thus, less axial load is absorbed by the suspension apparatus than if universal cup 67 were rotated such that the tail of the tailed axial member 66 were farther away from cap 50.

Figure 8C:
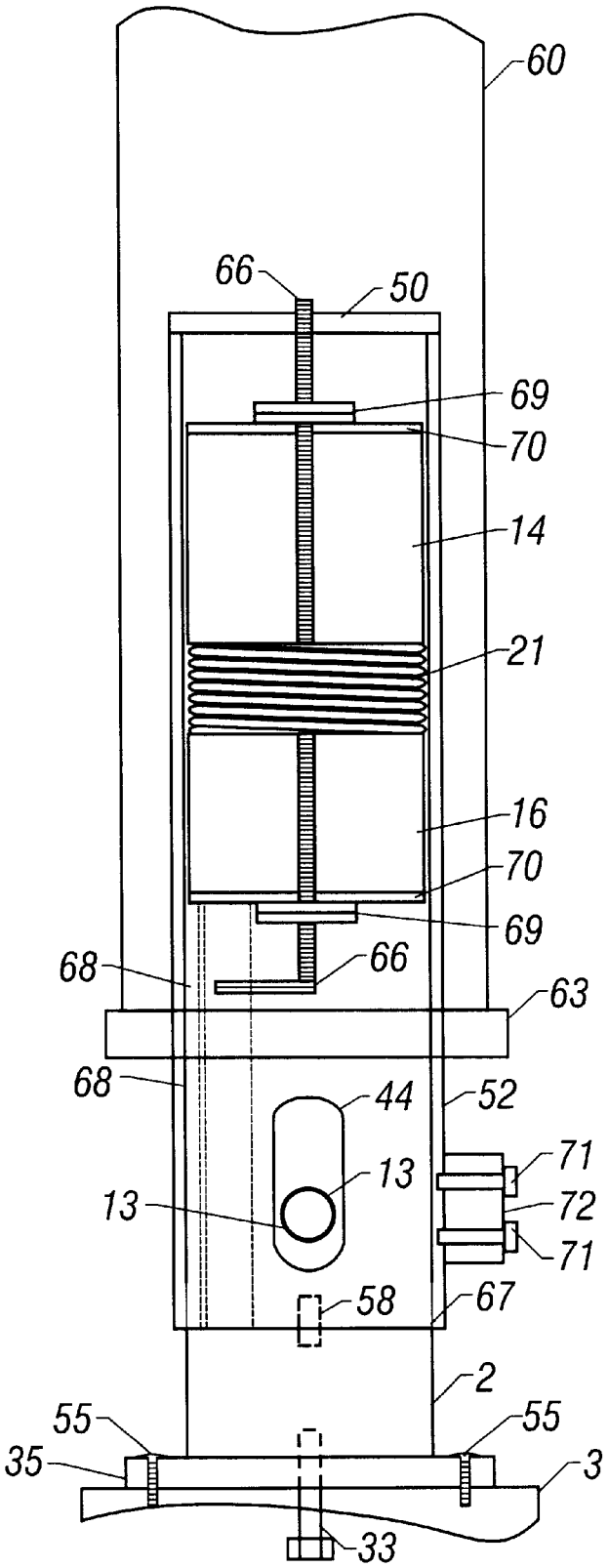
FIG. 8C shows the embodiment of FIGS. 8A and 8B including a rope cleat.

Referring to FIG. 8C, this embodiment shows the embodiment from FIGS. 8A and 8B, but includes externally mounted rope cleat 72 connected to mast support 52 by allen screws 71. Rope cleat 72 allows sails to be tethered to rope cleat 72. This embodiment operates identically to the embodiment shown in FIGS. 8A and 8B, except the mast member is also adjustably secured to mast support 52 by tethering the sail to external rope cleat 72.

As with the prior embodiments, mast member 60 can be made of various components. For example, mast member 60 can be a mast 1 alone, or the mast member can be made up of a mast surrounding a mast extender, the mast resting on a collar which is attached to a mast extender by a collar pin.

Figure 9:
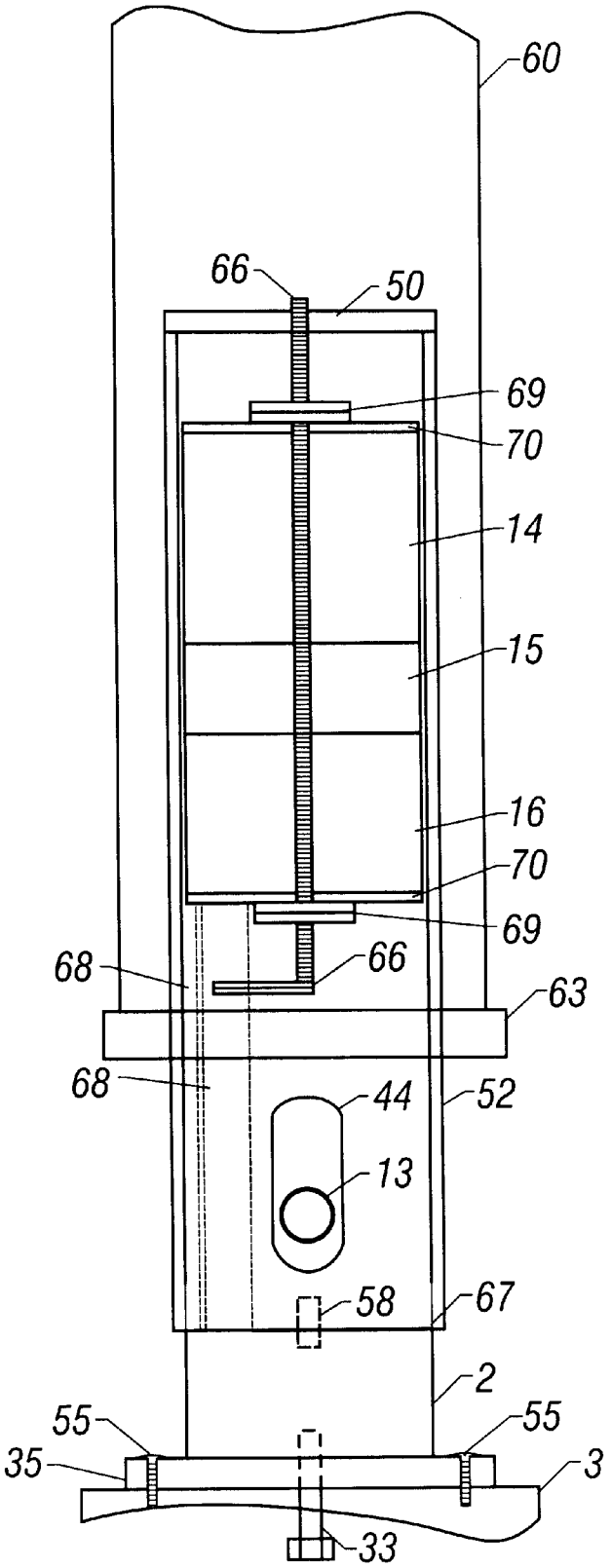
FIG. 9 shows another embodiment of the invention.

Referring to FIG. 9, this embodiment shows the compressible element made up of a first bumper 14, a separator 15, and a second bumper 16. This embodiment operates identically to the embodiment shown in FIGS. 8A and 8B except that separator 15 is solid and does not absorb axial loads. Thus, only first bumper 14 and second bumper 16 compress or expand to absorb axial load between mast member 60 and sailboard 3.

The appended claims are intended to cover all such modifications and variations not limited to the specific embodiments which occur to one of ordinary skill in the art; the claims are not limited to the specific embodiments earlier described.

Although various embodiments have been shown and described, the invention is not so limited and will be understood to include all such modifications and variations as would be apparent to one skilled in the art.

What is claimed is:

1. A suspension apparatus for a sailboard, the apparatus being designed for placement between a mast member and a base mounted on the sailboard, the apparatus comprising:

a housing member having a first end connectable to the base; and a shock absorbing system mounted to the housing member and adapted to support the mast member, the shock absorbing system comprising a compressible element, wherein the compressible element comprises a first bumper, a second bumper abutting the housing member, and a separator disposed between the first bumper and the second bumper.

2. The suspension apparatus according to claim 1, wherein the first bumper and the second bumper comprise an elastomeric material.

3. The suspension apparatus according to claim 2, wherein a hardness value of the first bumper is less than a hardness value of the second bumper.

4. The suspension apparatus according to claim 3, wherein the hardness value of the first bumper is approximately 62 durometers and the hardness value of the second bumper is approximately 70 durometers.

5. A suspension apparatus for a sailboard, the apparatus being designed for placement between a mast member and a base mounted on the sailboard, the apparatus comprising:

a housing member having a first end connectable to the base; and a shock absorbing system mounted to the housing member and adapted to support the mast member, the shock absorbing system comprising a compressible element, wherein the compressible element is connected to the housing member by an axial member having a first end and a second end, the first end being connected to the compressible element, and the second end being connected to the mast member.

6. The suspension apparatus according to claim 5, further comprising an anchor to connect the second end of the axial member to the mast member.

7. The suspension apparatus according to claim 6, further including a spring pin for connecting the anchor to the mast member.

8. The suspension apparatus according to claim 7, wherein the spring pin comprises a spring and first and second buttons coaxially disposed within a spring housing.

9. The suspension apparatus according to claim 5, further comprising:

a spring pin having two ends; and an anchor having an axial hole, the axis of the axial hole being perpendicular to the axis of the axial member;

which anchor is attached to the second end of the axial member, the spring pin passes through the hole in the anchor, and the ends of the spring pin are attached to the mast member.

10. The suspension apparatus according to claim 5, further comprising:

a first and second set of twin hex nuts;

a first and second washer;

a cap; and a mast support, the cap securing the mast support to the axial member, the compressible element being secured to the axial member by the first and second set of twin nuts and the first and second washers.

11. A suspension apparatus according to claim 10 wherein the mast support has elongated slots running parallel to the axial direction of the mast support.

12. The suspension apparatus according to claim 10, wherein the axial member has a tail.

13. A suspension apparatus for a sailboard, the apparatus being designed for placement between a mast member and a base mounted on the sailboard, the apparatus comprising:

a housing member having a first end connectable to the base, wherein the housing member comprises a collar member having a collar end and a male end, a supporting member having a secured end and an open end, the secured end being movably secured to the base, the male end of the collar being inserted into the open end of the supporting member, the collar member extending outside the supporting member, and attaching thereto; and a shock absorbing system mounted to the housing member and adapted to support the mast member, the shock absorbing system comprising a compressible element.

14. The suspension apparatus according to claim 13, wherein the supporting member is provided with elongated slots sunning parallel to the axial direction of the housing member.

15. The suspension apparatus according to claim 13, wherein the collar member is attached to the supporting member by at least one screw.

16. A suspension apparatus for a sailboard, the apparatus being designed for placement between a mast member and a base mounted on the sailboard, the apparatus comprising:

a housing member having a first end connectable to the base, the housing member further comprising a universal cup, wherein the universal cup possesses a side slot movably connected to the axial member for adjusting the suspension system;

a shock absorbing system mounted to the housing member and adapted to support the mast member, the shock absorbing system comprising a compressible element; and a connector fixedly attached to the universal cup, the connector connecting the universal cup to the shock absorbing system.

17. A shock absorbing system for a suspension apparatus for a sailboard, the suspension apparatus being designed for placement between a mast member and a base mounted on the sailboard, the shock absorbing system comprising:

an axial member having a first end and a second end;

a compressible element to absorb loads between the mast member and the base;

an anchor with a hole, the anchor attached to the second end of the axial member;

a spring pin to connect the second end of the axial member to the mast member by passing through the hole in the anchor; and a fastener to connect the first end of the axial member to the compressible element, wherein the fastener further comprising a manually adjustable element.

18. The shock absorbing system according to claim 17, wherein the compressible element has an axial hole along its length, the axial member passing through the hole.

* * * * *